US005816778A

United States Patent [19]

Elsey, Jr. et al.

[11] Patent Number: 5,816,778

[45] Date of Patent: Oct. 6, 1998

[54] SYSTEM FOR CONTROLLING THE STROKE LENGTH OF A DOUBLE-DIAPHRAGM PUMP

[75] Inventors: Frederick T. Elsey, Jr.; Bryce R. Peppard, both of Boise, Id.

[73] Assignee: Micron Technology, Inc., Boise, Id.

[21] Appl. No.: 585,699

[22] Filed: Jan. 16, 1996

[51] Int. Cl.[6] ..... F04B 49/00

[52] U.S. Cl. ..... 417/46; 417/53; 417/63; 417/393; 417/395

[58] Field of Search ..... 417/43, 46, 63, 417/53, 293, 393, 395; 91/1; 92/5 R

[56] References Cited

U.S. PATENT DOCUMENTS

| | | | |
|---|---|---|---|
| 4,381,180 | 4/1983 | Sell | 417/393 |
| 4,436,493 | 3/1984 | Credle, Jr. | 417/393 |
| 4,609,817 | 9/1986 | Mumzhiu | 250/231 SE |
| 4,682,937 | 7/1987 | Credle, Jr. | 417/393 |
| 5,052,273 | 10/1991 | Sakaguchi | 92/5 R |
| 5,238,029 | 8/1993 | Akeel | 92/5 R |
| 5,257,914 | 11/1993 | Reynolds | 417/43 |
| 5,367,944 | 11/1994 | Akeel et al. | 92/5 R |
| 5,511,458 | 4/1996 | Kamata et al. | 91/361 |

FOREIGN PATENT DOCUMENTS

| | | | |
|---|---|---|---|
| 0072771 | 4/1983 | Japan | 92/5 R |

OTHER PUBLICATIONS

*Chempure™ Diaphragm Pump*, manufactured by Furon Company, 1993.

*Primary Examiner*—Ayaz R. Sheikh
*Assistant Examiner*—Xuan M. Thai
*Attorney, Agent, or Firm*—Seed and Berry LLP

[57] ABSTRACT

A control system for controlling the stroke length of an axially reciprocating shaft in a double-diaphragm pump between a leftmost shaft position and a rightmost shaft position. In one embodiment, the control system includes a marker on the shaft of the pump. A sensor is positioned adjacent to the shaft and located along the longitudinal axis of the shaft with respect to the marker to sense a change in the position of the marker when the shaft is at the leftmost and rightmost positions. The sensor sends signals to a controller that in turn sends a response signal to a driver. The drive alternates directing pressurized air to a first air cell and a second air cell to selectively reciprocate the shaft in a desired direction between the leftmost and rightmost shaft positions.

17 Claims, 5 Drawing Sheets

SYSTEM FOR CONTROLLING THE STROKE LENGTH OF A DOUBLE-DIAPHRAGM PUMP

TECHNICAL FIELD

The present invention relates to a system for controlling the stroke length of an axially reciprocating shaft of a double-diaphragm pump.

BACKGROUND OF THE INVENTION

Manufacturing processes for microelectronic memory devices and field emission displays require accurate and durable fluid pumps. Microelectronic devices have minute, complex circuits that are fabricated by a number of different photomasking, etching, implanting and chemical-mechanical planarization processes. Many of these processes require semiconductor grade chemicals to be pumped to various locations in a manufacturing facility with a flow rate that must be precisely controlled so that fluids can be mixed with an accuracy that is often measured in the parts-per-billion ratio. Moreover, the pumps must continuously operate because microelectronic manufacturing processes require sophisticated, expensive equipment that operates around the clock to maximize the productivity of an assembly line. Therefore, fluid pumps that are used for manufacturing microelectronic devices must be durable to avoid costly downtime, and accurate to deliver precise quantities of chemicals.

One desirable type of pump is a double-diaphragm pump that has a first diaphragm coupled to a first end of an axially reciprocating shaft, and a second diaphragm coupled to a second end of the shaft. Each diaphragm constitutes a flexible wall that separates a liquid chamber from an air chamber. The liquid chambers are connected to a common intake manifold and a common discharge manifold, and check valves are positioned at the fluid inlets and outlets of the fluid chambers. In operation, the shaft is reciprocated by pressurizing the first air chamber while venting the second air chamber, and then venting the first air chamber while pressurizing the second air chamber. As the shaft moves in one direction, the first diaphragm pushes the fluid out of its fluid chamber into the discharge manifold, while the second diaphragm draws fluid into its fluid chamber from the intake manifold. Similarly, as the shaft moves in the other direction, the first diaphragm draws fluid into its chamber from the intake manifold, and the second diaphragm pushes the fluid out of its chamber into the discharge manifold.

One problem with conventional double-diaphragm pumps is that they do not consistently deliver an accurate volume of fluid after extended periods of use. The volume of fluid pumped through each fluid chamber is controlled by the distance that the shaft moves, which is a function of the air pressure in the air chambers. The air pressure in each air chamber is conventionally controlled by a needle valve positioned in each air supply line. Each needle valve is separately fixed at a desired flow rate by a lock nut that prevents the valve stem from moving. The lock nuts, however, loosen over time and allow the valve stems to move out of adjustment. Moreover, particles in the air line become attached to the internal components of the needle valves which restricts the air flow to the air chambers. The air pressure in one or both of the air chambers is thus likely to change over time causing the stroke length of the shaft to vary from its desired length. As a result, conventional double-diaphragm pumps are periodically removed from operation for re-calibration of the needle valves.

Another problem with conventional double-diaphragm pumps is that the diaphragms tend to have a shorter operational life than normal when the needle valves move out of adjustment. The stroke length of the shaft often increases when the needle valves move out of adjustment, causing the diaphragms to flex more than they would otherwise flex under normal operating conditions. Such an increase in flexure may significantly reduce the operational life of the diaphragms and result in down-time while the pumps are removed from operation for repair.

The problems of conventional double-diaphragm pumps are especially costly when the pumps are used for manufacturing microelectronic devices because the semiconductor grade chemicals must be delivered accurately and continuously in light of the high capital cost of the manufacturing facilities and the high cost of the skilled labor. Accordingly, it would be desirable to develop a system for accurately controlling the stroke length of a double-diaphragm pump that maintains a desired stroke length over extended periods of time.

SUMMARY OF THE INVENTION

The inventive system controls the stroke length of an axially reciprocating shaft in a double-diaphragm pump between a leftmost shaft position and a rightmost shaft position. In one embodiment, the control system includes a marker on the shaft of the pump. A sensor is positioned adjacent to the shaft and located along the longitudinal axis of the shaft with respect to the marker to sense a change in the position of the marker when the shaft is at the leftmost and rightmost shaft positions. The sensor sends signals to a controller that sends a response signal to a driver to alternate directing pressurized air to a first air cell and a second air cell to selectively reciprocate the shaft in a desired direction between the leftmost and rightmost shaft positions.

Another embodiment of the invention is a double-diaphragm pump that has a housing, a shaft, a sensor, and a controller. The housing has a first end with a first liquid chamber and a first air cell, and a second end with a second liquid chamber and a second air cell. The shaft is positioned in the housing, and it has a first end coupled to a first diaphragm and a second end coupled to a second diaphragm. The first diaphragm defines a flexible wall between the first liquid chamber and the first air cell, and the second diaphragm defines a flexible wall between the second liquid chamber and the second air cell. The shaft is axially reciprocally moveable between a leftmost position in which fluid is expelled from the first chamber and a rightmost position in which fluid is expelled from the second fluid chamber. A marker is positioned on the shaft. The sensor is positioned adjacent to the shaft and located along the longitudinal axis of the shaft with respect to the marker to sense a change in position of the marker when the shaft is in the leftmost or rightmost shaft positions. The sensor sends signals to a controller that sends a response signal to a driver to alternate directing pressurized air to a first air cell and a second air cell to selectively reciprocate the shaft in a desired direction between the leftmost and rightmost positions according to the signals from the sensor.

DETAILED DESCRIPTION OF THE INVENTION

The present invention provides an accurate, durable apparatus for controlling the stroke length of an axially reciprocating shaft in a double-diaphragm pump over an extended period of time. An important aspect of the invention is that the stroke length of the shaft is controlled by continuously monitoring the actual position of the shaft and limiting the movement of the shaft by correlating its actual position with the endpoints of the desired stroke length. By continuously monitoring the actual position of the shaft and limiting the movement of the shaft accordingly, the desired stroke length of the shaft can be maintained over an extended period of time without frequent adjustments or cleaning. FIGS. 1–12 illustrate an embodiment of an apparatus for accurately controlling the stroke length of a double-diaphragm pump over an extended period of use, and like reference numbers refer to like parts throughout the various figures.

Figure 1:
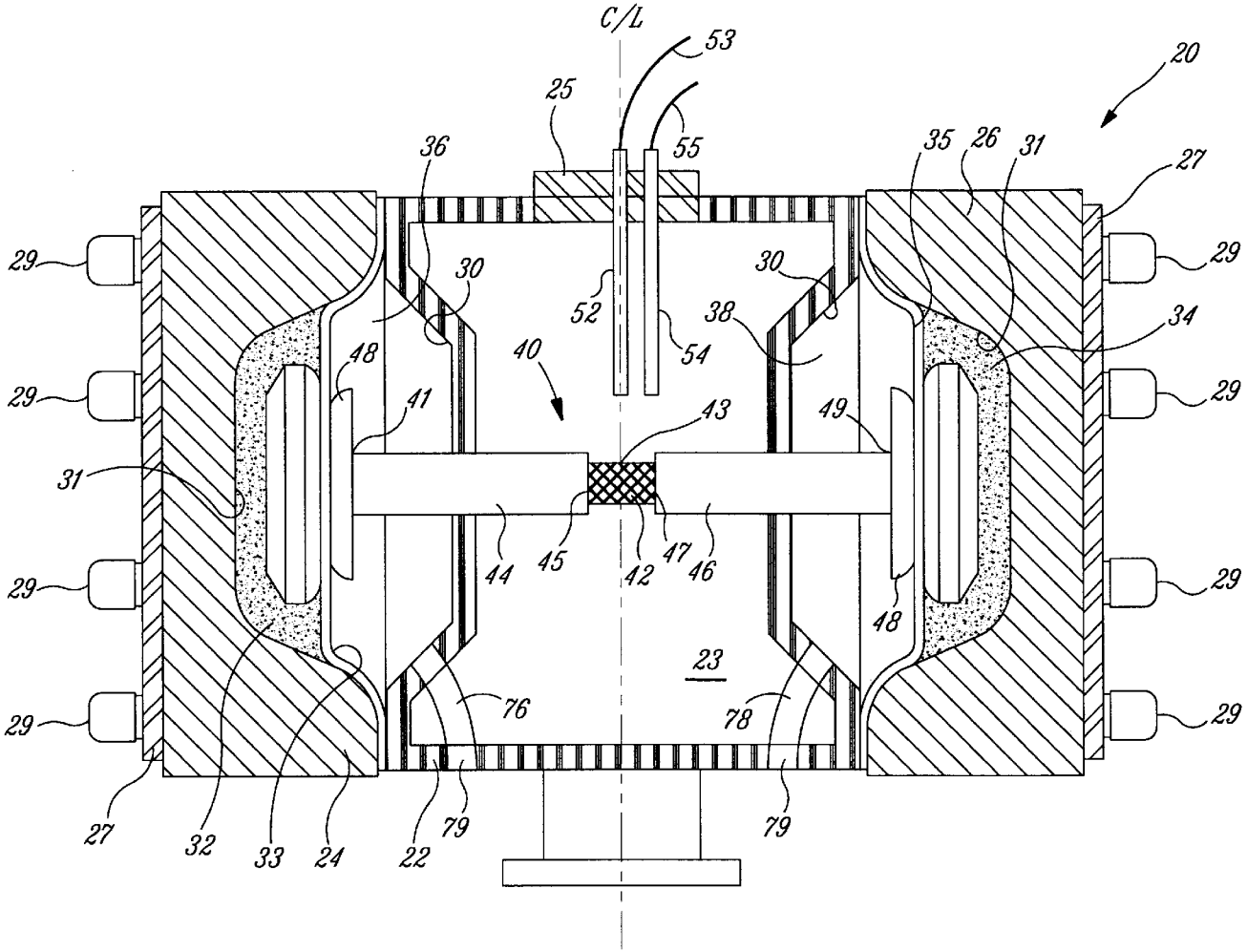
FIG. 1 is a side cross-sectional view of a double-diaphragm pump with an apparatus for controlling the stroke length of an axially reciprocating shaft in accordance with the invention.

FIG. 1 illustrates a double-diaphragm pump 20 that has a central housing 22, a first end housing 24, and a second end housing 26. The housings are held together by a number of long rods (not shown) that extend beyond the full length of the assembled housings and have nuts 29 threadably attached to each end. A ring 27 may be positioned between the end housings and the nuts 29 to more evenly distribute the compression forces of the rods and nuts. The central housing 22 has a basin 30 on each end and an interior cavity 23. The end housings each have an interior recess 31 juxtaposed to a corresponding basin 30 of the central housing 22.

A first diaphragm 33 is positioned between the recess 31 of the first end housing 24 and the left basin 30 of the central housing 22. The first diaphragm 33 is a flexible wall that separates a first fluid chamber 32 from a first air cell 36. Similarly, a second diaphragm 35 is positioned between the right basin 30 and the recess 31 of the second end housing 26. The second diaphragm 35 is a flexible wall that separates a second fluid chamber 34 from a second air cell 38. Air passages 76 and 78 are connected to the first air cell 36 and second air cell 38, respectively. Each of the air passages 76 and 78 has a threaded portion 79 for receiving a male fitting of a pressurized air line. The diaphragms 33 and 35 are made from a flexible, low friction material such as rubber coated with Teflon®.

A shaft 40 is positioned along the longitudinal axis of the pump 20. The shaft 40 has a first end 41 connected to a back plate 48 in the first air cell 36, and a second end 49 connected to another back plate 48 in the second air cell 38. The back plate 48 on the first end 41 of the shaft 40 is coupled to the first diaphragm 33, and the back plate 48 on the second end 49 of the shaft 40 is coupled to the second diaphragm 35.

A marker 42 is positioned on the shaft 40. The marker 42 may be a single narrow band or cut, a wide band or cut, or multiple bands of any given width along the length of the shaft 40. The marker 42 divides the shaft into at least a first section 44 and a second section 46. The first section 44 extends from a left boundary line 45 to the first end 41 of the shaft 40, and the second section 46 extends from a right boundary line 47 to the second end 49 of the shaft 40. The boundary lines 45 and 47 of the marker 42 are preferably optically distinguishable from the first and second sections 44 and 46 such that an optical sensor emitting a given wavelength of light can sense when it is over the boundary lines 45 and 47, or one of the first or second sections 44 or 46. In one embodiment, the marker 42 is covered by a material that generally absorbs the light emitted from the sensor, and the first and second sections 44 and 46 are made from a material that reflects the light. In another embodiment, the marker 42 is conversely made from a material that reflects the wavelength of light emitted from the sensor, and the boundary lines 45 and 47 are made from a material that absorbs the wavelength of light. The marker 42 is preferably covered by a material that absorbs the given wavelength of light, and it is notched into the shaft 40 so that the sensor may be positioned closer to the reflective first and second sections 44 and 46 than the marker 42. The notch in the shaft 40 also enhances removal of the shaft 40 when the pump is serviced.

The marker 42 may also be mechanically distinguishable from the first and second sections 44 and 46 such that a mechanical sensor (not shown) near or contacting the surface of the shaft 40 can sense when it is at the boundary lines 45 and 47. The mechanical sensor may be a pivoting arm (not shown) that senses a topographic feature (not shown) on the shaft 40 positioned at the boundary lines 45 and 47. The topographic feature may be a dimple, a raised tooth, or a notch cut into the shaft. When the topographic feature is a notch, the length of the notch may be equal to the desired stroke length of the shaft 40. In this embodiment, the mechanical sensor engages the topographic feature positioned at the boundary lines 45 and 47 to sense when the shaft has reached the endpoints of the desired stroke length of the shaft 40.

A cap 25 is positioned in-the top of the center housing 22, and at least a first sensor 52 is mounted to the cap and positioned adjacent to the shaft 40. In one embodiment, the first sensor 52 and a second sensor 54 are mounted to the cap 25 and positioned apart from each other along the axis of the shaft 40 by a distance equal to one-half of the desired stroke length of the shaft. When the shaft 40 is centered with respect to the centerline C/L of the pump 20, the first sensor 52 may be positioned in alignment with the midpoint 43 of the marker 42 and the second sensor 54 may be aligned with one of the boundary lines 45 or 47. The invention, however, is not limited to two sensors that are positioned apart from each other by a distance equal to one-half of the desired stroke length of the shaft 40. As discussed below with respect to FIGS. 6–12, the first sensor 52 may be positioned by itself or in conjunction with the second sensor 54 at various points along the shaft 40 relative to the marker 42.

Figure 2:
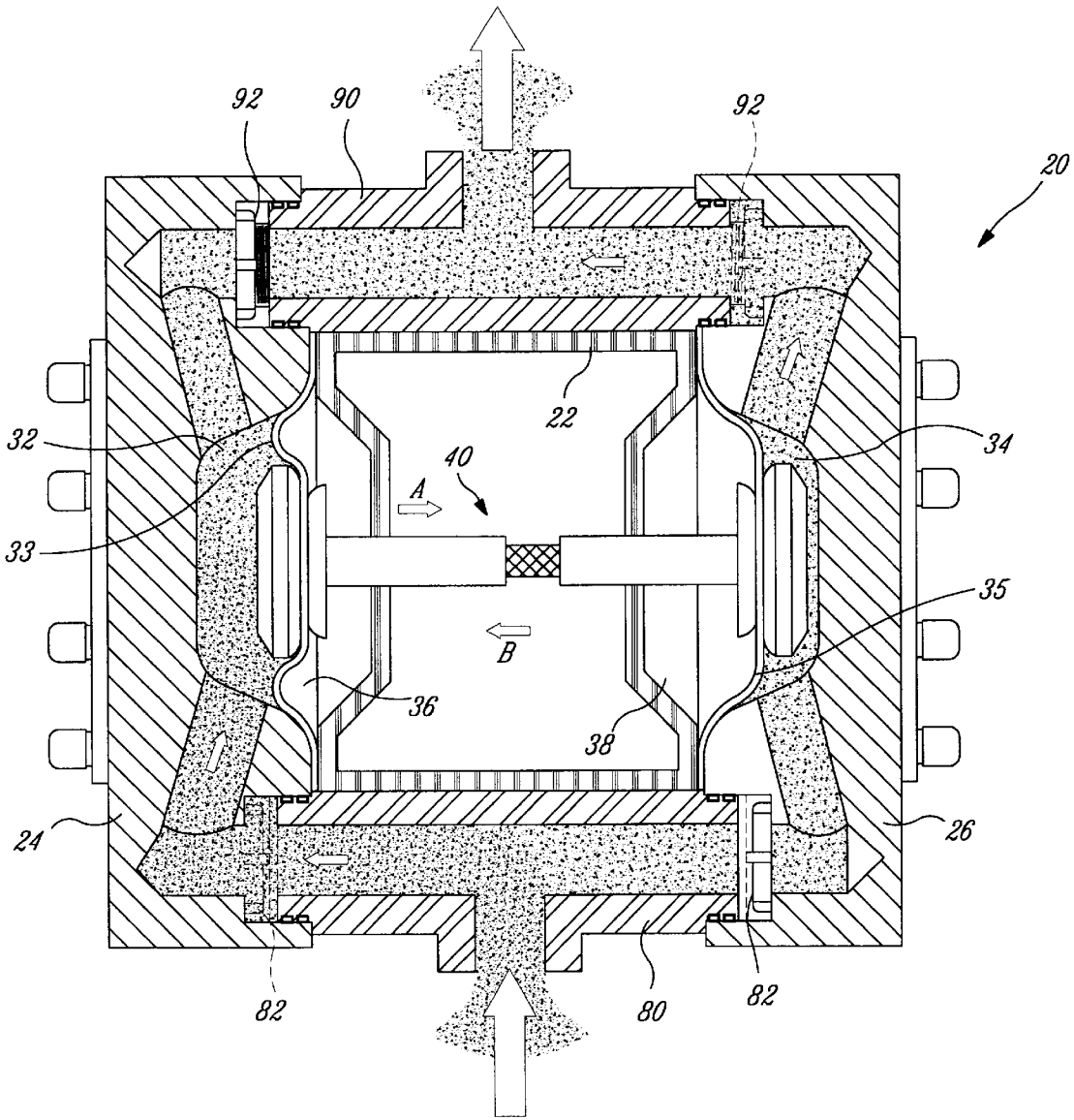
FIG. 2 is a top cross-sectional view of the double-diaphragm pump of FIG. 1.

FIG. 2 illustrates a top view of a cross-section of the pump 20. In addition to the components discussed above with respect to FIG. 1, the pump 20 also includes an intake manifold 80 and a discharge manifold 90 in fluid communication with the first and second fluid chambers 32 and 34. A check valve 82 is positioned at each end of the intake manifold 80, and a check valve 92 is positioned at each end of the discharge manifold 90. In operation, the shaft 40 is driven in the direction of arrow A by pressurizing the second air cell 38 through air passage 78 and simultaneously venting the first air cell 36. As the shaft 40 moves in the direction of arrow A, an equal volume of fluid is drawn into the first fluid chamber 32 and simultaneously discharged from the second fluid chamber 34. When the shaft 40 reaches the maximum desired rightmost position, the sensors 52 and 54 (FIG. 1) send an appropriate combination of signals to a controller (not shown in FIG. 2) to move the shaft 40 in the direction of arrow B by pressurizing the first air cell 36 through air passage 76 and simultaneously venting the second air cell 38. As the shaft moves in the direction of arrow B, fluid is discharged from the first fluid chamber 32 and simultaneously drawn into the second fluid chamber 34. The pump operates by reciprocating the shaft 40 back and forth between the leftmost position and the rightmost position.

Figure 3:
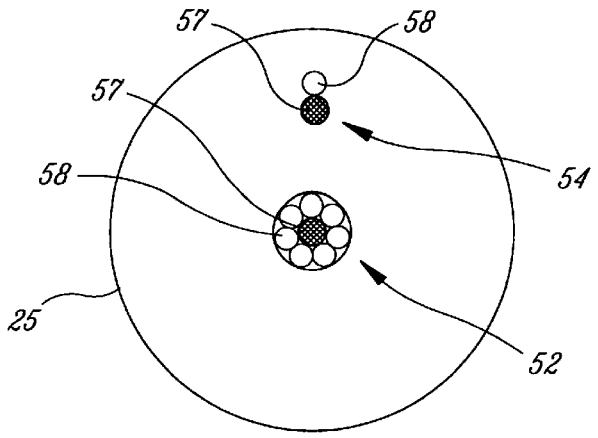
FIG. 3 is a bottom cross-sectional view of optical sensors used in an apparatus for controlling the stroke length of an axially reciprocating shaft in a double-diaphragm pump.

FIG. 3 illustrates a preferred embodiment of the invention in which the first and second sensors 52 and 54 are optical sensors. The first sensor 52, which depicts one type of suitable optical sensor, has a centrally disposed emitter 57 that is surrounded by a number of fiber optic receivers 58. The second sensor 54 depicts a dual line sensor in which the emitter 57 and fiber optic receiver 58 are positioned side-by-side. In a preferred embodiment, the first and second sensors 52 and 54 are of the same type. The optical sensors are positioned adjacent to the shaft 40 across a narrow gap, as shown by FIGS. 1 and 2. When the sensors are aligned with the reflective surfaces of the first and second sections 44 and 46, the light from the emitters reflects off the first and second sections and back up the fiber optic receiver 58 to a controller (not shown in FIG. 3). When the sensors are aligned with the marker 42, however, the light from the emitters 57 is substantially absorbed by the marker 42 and does not travel through the receivers 58 to the controller.

Figure 4:
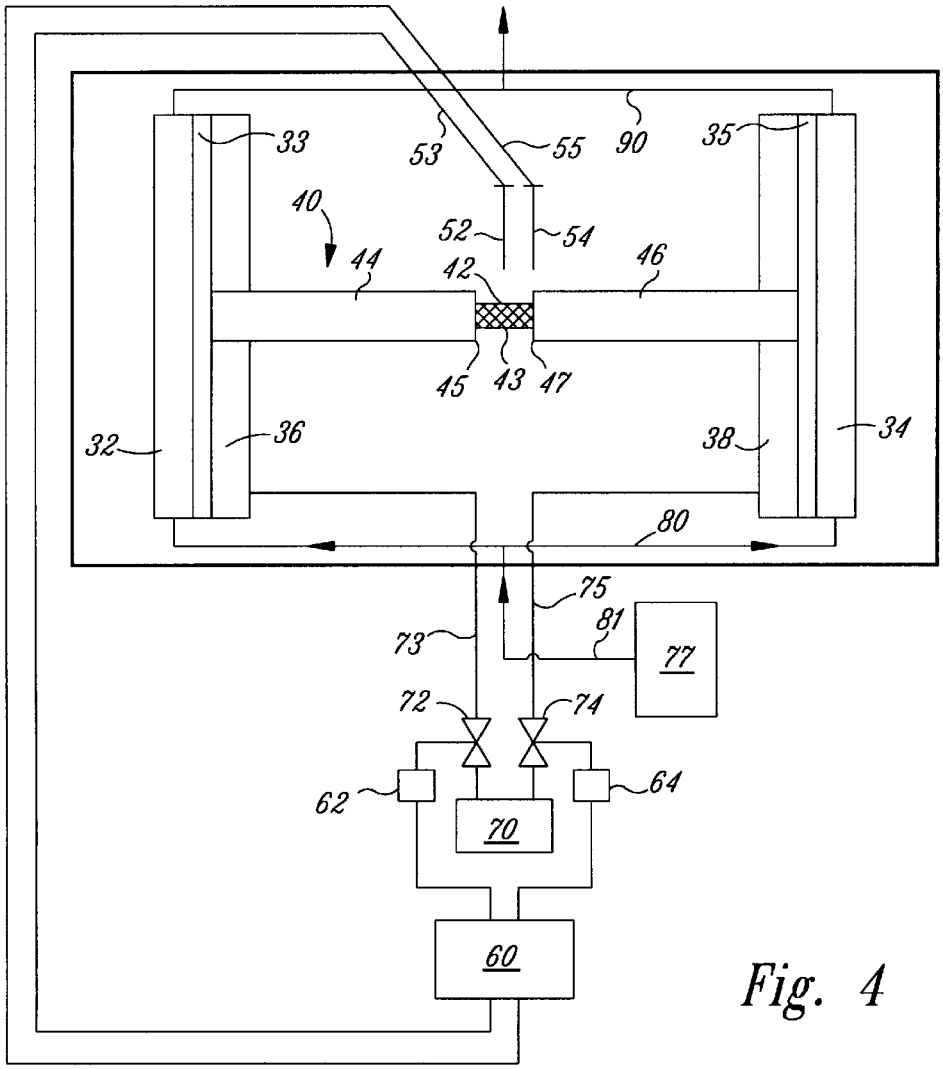
FIG. 4 is a schematic diagram of an apparatus for controlling the stroke length of an axially reciprocating shaft in a double-diaphragm pump in accordance with the invention.

FIG. 4 schematically illustrates the stroke length control system of the invention in conjunction with the double-diaphragm pump 20. A first fiber optic line 53 and a second fiber optic line 55 are connected to the input of a controller 60 and the first and second optical sensors 52 and 54, respectively. The controller 60 is a commercially available controller such as the SP-10 manufactured by Omron Electronics located in Schaumburg, Ill. A first solenoid 62 is connected to one output of the controller, and a second solenoid 64 is connected to another output of the controller. The first and second solenoids 62 and 64 operate the first and second solenoid valves 72 and 74, respectively. The solenoid valves 72 and 74 are preferably Humphrey valves that vent the downstream air line when they are closed. A first air line 73 is connected to the air passage 76 and the first solenoid valve 72, and a second air line 75 is connected to the air passage 78 and the second solenoid valve 74. The fluid is stored in a tank 77, which is connected to the intake manifold 80 by a feed line 81.

In operation of the embodiment of the invention shown in FIGS. 1–4, the first and second sensors 52 and 54 generate a different combination of signals depending upon the position of the marker 42, first section 44, and second section 46 with respect to the sensors. The combination of signals from the sensors indicates whether the shaft 40 is at the center position, leftmost position, rightmost position, or somewhere therebetween. When the shaft 40 is at the leftmost position, the signals from the sensors prompt the controller 60 to send a signal to the first and second solenoids 62 and 64 to close the first solenoid valve 72 and open the second solenoid valve 74. After the valve 74 is opened, pressurized air from an air supply 70 flows into the second air cell 38 via the second solenoid valve 74 and air line 75 to drive the shaft 40 in the direction of arrow A towards the rightmost position. Once the shaft 40 reaches the rightmost position, the signals from the sensors 52 and 54 prompt the controller 60 to send a signal to the first and second solenoids 62 and 64 to close the second solenoid valve 74 and open the first solenoid valve 72. The pressurized air from the air supply 70 flows into the first air cell 36 via the first solenoid valve 72 and air line 73 to drive the shaft 40 in the direction of arrow B towards the leftmost position.

Figure 5A:
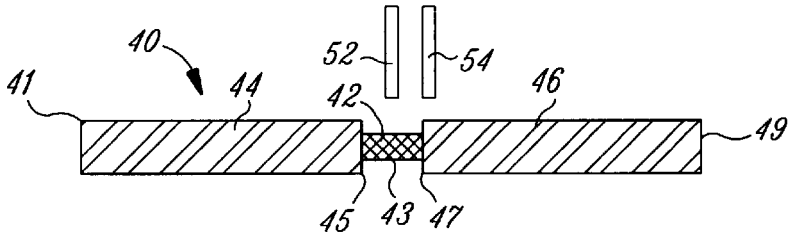
FIG. 5A is a partial cross-sectional view of an axially reciprocating shaft and sensors in accordance with the invention, wherein the shaft is in a center position.
Figure 5B:
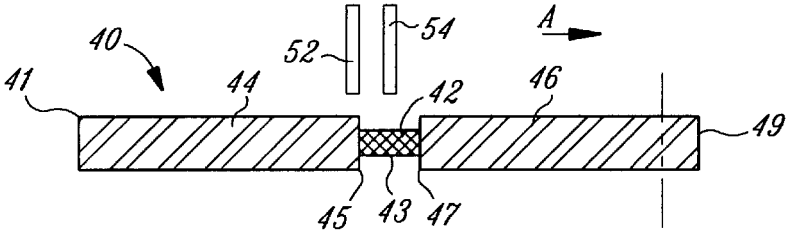
FIG. 5B is a partial cross-sectional view of the axially reciprocating shaft and sensors of Figure 5A, wherein the shaft is in a rightmost position.
Figure 5C:
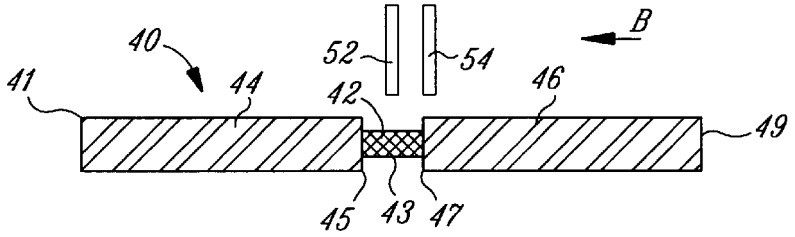
FIG. 5C is a partial cross-sectional view of the axially reciprocating shaft and sensors of Figure 5A, wherein the shaft is back in the center position.
Figure 5D:
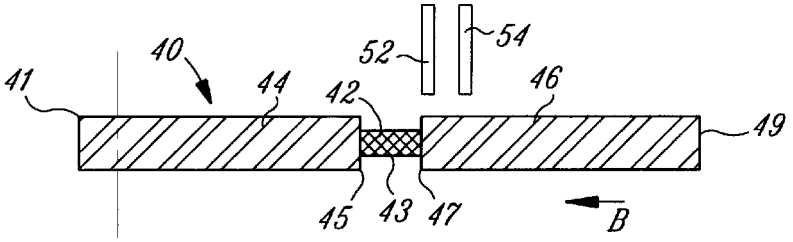
FIG. 5D is a partial cross-sectional view of the axially reciprocating shaft and sensors of Figure 5A, wherein the shaft is in a leftmost position.
Figure 5E:
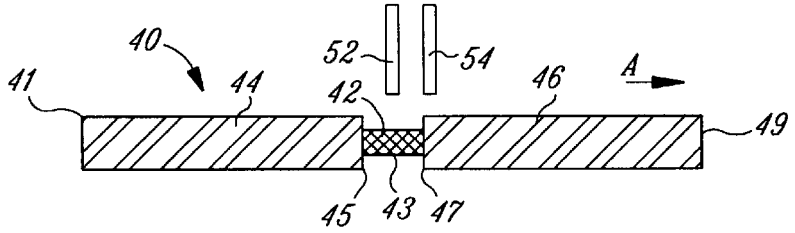
FIG. 5E is a partial cross-sectional view of the axially reciprocating shaft and sensors of FIG. 5A, wherein the shaft is back in the center position.

FIGS. 5A–5E illustrate one embodiment of the signals from the sensors and the logic used to control the shaft 40. In this embodiment, the boundary lines 45 and 47 are spaced apart from each other by a distance equal to the desired stroke length, and the first and second sensors are spaced apart from each other by a distance equal to one-half of the desired stroke length. The optical sensors 52 and 54 are on when they are aligned with the first or second sections 44 or 46, and off when they are aligned with the marker 42. The shaft 40 is centered at the centerline C/L when the first sensor 52 is aligned with the midpoint 43 of the marker 42, and the second sensor 54 is aligned with the right boundary line 47, as shown in FIG. 5A. At this point, the first sensor 52 is "on" and the second sensor 54 is "on" to indicate that the shaft 40 is positioned between the center position and the leftmost position. As the shaft 40 moves from the centered position towards the rightmost position in the direction of arrow A, the sensors 52 and 54 are on and off, respectively, as they are both positioned over the marker 42. When the shaft 40 reaches the rightmost position as shown in FIG. 5B, the first sensor 52 turns "off" when it is aligned with the left boundary line 45, while the second sensor 54 remains "off" since it is aligned with the marker 42. Accordingly, the change of the first sensor's 52 signal from "on" to "off" while the second sensor 54 is "off" indicates that the shaft 40 is in the rightmost position and that the controller 60 should signal the solenoids to open valve 72 and close valve 74. Referring to FIGS. 5B–D, as the shaft moves in the direction of arrow B from the rightmost position, the first sensor 52 turns "on", and the second sensor 54 remains "off" until the shaft reaches the center position (FIG. 5C). At the moment the shaft reaches the center position when coming from the rightmost position, the first sensor 52 remains "on" and the second sensor 54 turns "on". The shaft 40 continues to move in the direction of arrow B until the first sensor is aligned with the right boundary line 47 and turns "off". At this point, the "off-on" signal from the sensors indicates that the shaft 40 is in the leftmost position and that the controller 60 should signal the solenoids to close valve 72 and open valve 74. Accordingly, the shaft 40 is driven in the direction of arrow A until it reaches the rightmost position, as shown in FIG. 5B.

Figure 6:
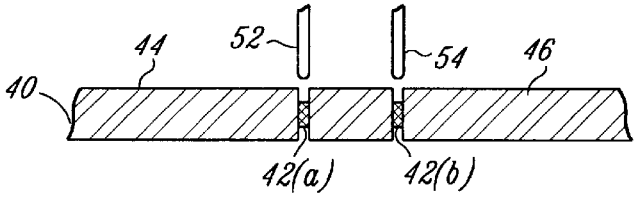
FIG. 6 is a partial cross-sectional view of an axially reciprocating shaft and sensors in accordance with the invention, wherein the shaft is in a center position.

FIG. 6 illustrates another embodiment of the invention with two markers 42(*a*) and 42(*b*) positioned along the length of the shaft. Each marker is a narrow band in which the boundary lines are superimposed upon one another. When the shaft 40 is in the center position, the first and second sensors 52 and 54 are positioned over the markers 42(*a*) and 42(*b*), respectively. The first and second sensors 52 and 54 are positioned apart from each other by one-half of the desired stroke length of the shaft 40 so that the shaft is in the leftmost position when marker 42(*b*) is aligned with the first sensor 52, and in the rightmost position when marker 42(*a*) is aligned with the second sensor 54.

Figure 7:
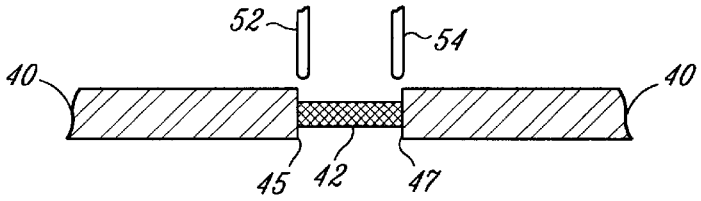
FIG. 7 is a partial cross-sectional view of another axially reciprocating shaft and sensors in accordance with the invention, wherein the shaft is in a center position.

FIG. 7 illustrates another embodiment of the invention in which the marker 42 is a continuous zone of light-absorbing material. When the shaft 40 is in the center position, the first and second sensors 52 and 54 are aligned with the right and left boundary lines 45 and 47 of the marker, respectively. In this embodiment, the shaft is in the leftmost position when the right boundary line 47 is aligned with the first sensor 52, and in the rightmost position when the left boundary line 45 is adjacent to the second sensor 54.

Figure 8:
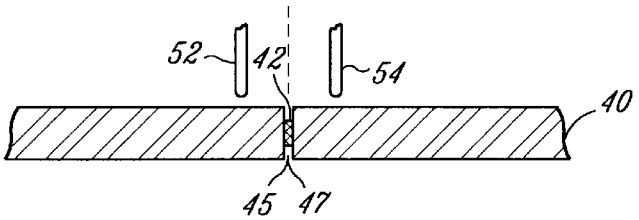
FIG. 8 is a partial cross-sectional view of another axially reciprocating shaft and sensors in accordance with the invention, wherein the shaft is in a center position.

FIG. 8 illustrates another embodiment of the invention in which the marker 42 is a single, narrow band in which the left and right boundary lines 45 and 47 are superimposed upon one another. In this embodiment, the shaft 40 is in the leftmost position when the marker 42 is aligned with the first sensor 52, and in the rightmost position when the marker 42 is aligned with the second sensor 54.

Figure 9:
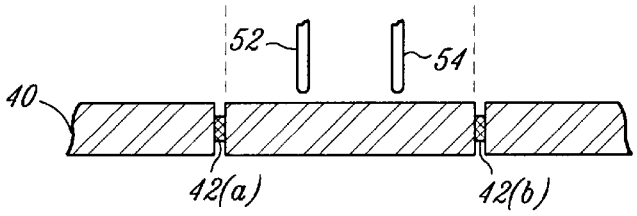
FIG. 9 is a partial cross-sectional view of another axially reciprocating shaft and sensors in accordance with the invention, wherein the shaft is in a center position.
Figure 10:
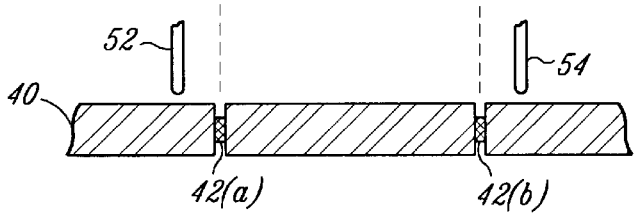
FIG. 10 is a partial cross-sectional view of another axially reciprocating shaft and sensors in accordance with the invention, wherein the shaft is in a center position.

FIGS. 9 and 10 illustrate another embodiment of the invention with two markers 42(*a*) and 42(*b*) spaced apart from each other along the shaft 40 by virtually any distance. In these embodiments, the shaft 40 is at one of the end points of the desired stroke length when one of the markers is aligned with one of the sensors. In the embodiment shown in FIG. 9, the shaft is in the leftmost position when marker 42(*b*) is aligned with the second sensor 54, and in the rightmost position when marker 42(*a*) is aligned with the first sensor 52. Referring to FIG. 10, the shaft is in the leftmost position when marker 42(*a*) is aligned with the first sensor 52, and in the rightmost position when marker 42(*b*) is aligned with the second sensor 54.

Figure 11:
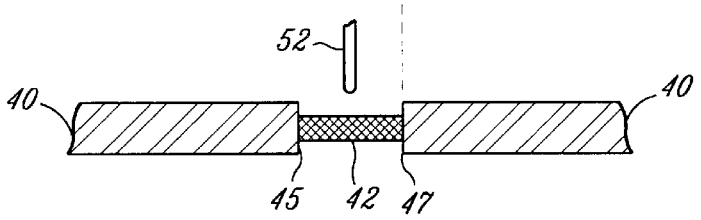
FIG. 11 is a partial cross-sectional view of another axially reciprocating shaft and a sensor in accordance with the invention, wherein the shaft is in a center position.
Figure 12:
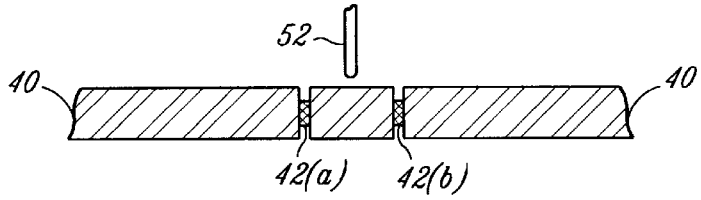
FIG. 12 is a partial cross-sectional view of another axially reciprocating shaft and a sensor in accordance with the invention, wherein the shaft is in a center position.

FIGS. 11 and 12 illustrate embodiments of the invention that only require a single sensor for indicating the position of the shaft. Referring to FIG. 11, the first sensor 52 is positioned over the midpoint of the marker 42 when the shaft 40 is in the center position. The marker 42 is configured onto the shaft to be a continuous region of light-absorbing material that terminates at the left and right boundary lines 45 and 47. Referring to FIG. 12, the markers 42(*a*) and 42(*b*) are narrow bands of light absorbing material. In operation, the single sensor 52 senses the presence of the markers 42(*a*) and 42(*b*) indicate whether the shaft is at the rightmost or the leftmost positions, respectively. An additional input from the solenoid valves may be used to indicate which valve is operating, and thus in conjunction with the input from the sensor 52, the combination of the signals from the sensor and the solenoid valves can indicate whether the shaft is in the leftmost position or the rightmost position.

In another embodiment with a single sensor (not shown), the first and second sections 44 and 46 are optically distinguishable from one another so that a single optical sensor can sense whether it is over the marker 42, first section 44, or second section 46 without any other input. In such an embodiment, the marker 42 may reflect the light, the first section 44 may absorb one wavelength of light, and the second section 46 may absorb a different wavelength of light. Thus, a single optical sensor that can distinguish the absence of the different wavelengths of light can sense whether it is positioned over the marker 42, the first section 44, or second section 46.

The present invention provides a system for controlling the precise stroke length of the shaft 40 by continuously regulating the position of the shaft as opposed to regulating the air pressure that controls the shaft. The control system of the present invention maintains the desired stroke length regardless of the air pressure and does not need to be continuously adjusted because it accurately determines the endpoints of the desired stroke length by monitoring the position of the marker 42 on every cycle of the shaft 40. Moreover, an optical control system does not have any moving parts except for the shaft 40 itself, and thus it is not subject to becoming loose over time due to the vibrations of the pump.

It will be appreciated that, although specific embodiments of the invention have been described herein for purposes of illustration, various modifications may be made without departing from the spirit and scope of the invention. Accordingly, the invention is not limited except as by the appended claims.

What is claimed is:

1. An apparatus for controlling the desired stroke length of an axially reciprocating shaft in a double-diaphragm pump between a leftmost shaft position and rightmost shaft position, comprising:

a single marker positioned on the shaft, the single marker having a left boundary line and a right boundary line;

a plurality of sensors including a first sensor and a second sensor positioned adjacent to the shaft, the first and second sensors being configured with respect to the left and right boundary lines of the single marker to indicate when the shaft is at the leftmost and rightmost positions; and a controller for receiving signals from the first and second sensors and sending a response signal to a driver, wherein the driver alternates directing pressurized air to a first air cell and a second air cell to selectively reciprocate the shaft between the leftmost and rightmost shaft positions corresponding to the leftmost and rightmost indications from the first and second sensors.

2. The apparatus of claim 1 wherein the first sensor is an optical sensor, the second sensor is an optical sensor, and the marker are configured so that the first and second optical sensors indicate when the shaft is at the leftmost, center, and rightmost positions.

3. The apparatus of claim 2 wherein the marker substantially absorbs light emitted from the sensor.

4. The apparatus of claim 2 wherein the marker substantially reflects light emitted from the sensor.

5. The apparatus of claim 2 wherein the first and second sensors are positioned adjacent to left and right boundary lines of the marker, respectively, when the shaft is centered between the leftmost and rightmost shaft positions.

6. The apparatus of claim 2 wherein the marker has a left boundary line and a right boundary line and the sensor senses the change in position of the marker when the sensor is adjacent to at least one of the left and right boundary lines.

7. An apparatus for controlling the desired stroke length of an axially reciprocating shaft in a double-diaphragm pump between a leftmost shaft position and a rightmost shaft position, comprising:

a first marker positioned on the shaft and a second marker positioned on the shaft apart from the first marker;

a first optical sensor and a second optical sensor positioned adjacent to the shaft and located along the longitudinal axis of the shaft with respect to the first and second markers such that the first marker is positioned on the shaft away from the first optical sensor by one-half of the desired stroke length and the second marker is positioned on the shaft away from the second optical sensor by one-half of the desired stroke length when the shaft is centered between the leftmost and rightmost shaft positions, the first and second optical sensors sensing a change in the position of the marker when the shaft is at the leftmost and rightmost positions; and a controller for receiving signals from the first and second optical sensors and sending response signals to a driver, wherein the driver alternates directing pressurized air to a first air cell and a second air cell to selectively reciprocate the shaft between the leftmost and rightmost shaft positions.

8. An apparatus for controlling the desired stroke length of an axially reciprocating shaft in a double-diaphragm pump between a leftmost shaft position and a rightmost shaft position, comprising:

a marker configured onto the shaft to divide the shaft into a first section and a second section with the marker being positioned therebetween, the marker having a length equal to the desired stroke length of the shaft and being positioned lengthwise along the axis of the shaft;

a first sensor positioned adjacent to the shaft and aligned with the midpoint of the marker when the shaft is centered between the leftmost and rightmost shaft positions;

a second sensor positioned adjacent to the shaft and aligned with the boundary between the marker and one of the first and second sections when the shaft is centered between the leftmost and rightmost shaft positions; and a controller for receiving signals from the first and second sensors and selectively reciprocating the shaft in a desired direction between the leftmost and rightmost shaft positions.

9. The apparatus of claim 8 wherein the first sensor and second sensor are optical sensors that can distinguish the marker from the first and second sections of the shaft.

10. The apparatus of claim 9 wherein the marker absorbs light emitted from the optical sensors.

11. The apparatus of claim 10 wherein the marker is a notch cut into the shaft.

12. The apparatus of claim 8 wherein the marker is a notch cut into the shaft.

13. A double-diaphragm pump, comprising:

a housing having a first end with a first liquid chamber and a first air cell, and a second end with a second liquid chamber and a second air cell;

a shaft positioned in the housing, the shaft having a first end coupled to a first diaphragm and a second end coupled to a second diaphragm, the first diaphragm defining a flexible wall between the first liquid chamber and first air cell and the second diaphragm defining a flexible wall between the second liquid chamber and second air cell, the shaft being axially reciprocally moveable between a leftmost position in which fluid is expelled from the first fluid chamber and a rightmost position in which fluid is expelled from the second fluid chamber;

a single marker on the shaft, the single marker having a left boundary line and a right boundary line;

a a plurality of sensors including a first sensor and a second sensor positioned adjacent to the shaft, the first and second sensors being configured with respect to the left and right boundary lines of the single marker to indicate when the shaft is at the leftmost and rightmost shaft positions; and a controller for receiving the signals from the first and second sensors and sending a response signal to a driver, wherein the driver alternates directing pressurized air to a first air cell and a second air all to selectively reciprocate the shaft in a desired direction between the leftmost and rightmost shaft positions corresponding to the leftmost and rightmost indications from the first and second sensors.

14. The double-diaphragm pump of claim 13 wherein the first sensor is an optical sensor, the second sensor is an optical sensor, and the marker are configured so that the first and second optical sensors indicate when the shaft is at the leftmost, center, and rightmost positions.

15. The double-diaphragm pump of claim 14 wherein the marker absorbs light emitted from the optical sensors.

16. The double-diaphragm pump of claim 13 wherein the marker is a notch cut into the shaft.

17. A method of controlling the stroke length of an axially reciprocating shaft in a double-diaphragm pump between a leftmost shaft position and a rightmost shaft position, wherein a marker is positioned on the shaft and a sensor is positioned adjacent to the shaft and located along the longitudinal axis of the shaft with respect to the marker to sense a change in the position of the marker when the shaft is at the leftmost and rightmost positions, the method comprising the steps of:

continuously sensing the position of the marker with respect to the sensor;

indicating when the shaft is in the leftmost position;

moving the shaft towards the rightmost position after it reaches the leftmost position;

sensing when the shaft is in a center position;

indicating when the shaft is in the rightmost position;

moving the shaft towards the leftmost position after it reaches the rightmost position; and repeating the indicating sensing and moving steps so as to continuously reciprocate the shaft between the leftmost and rightmost positions.

* * * * *